United States Patent [19]

Lee

[11] Patent Number: 4,990,082

[45] Date of Patent: Feb. 5, 1991

[54] VIBRATOR WITH SUCTION APPARATUS

[76] Inventor: Yuan-Ho Lee, No. 851, Chung-San Rd., Nan-Pao Tsun, Kuei-Jen Hsian, Tainan Hsieng, Taiwan

[21] Appl. No.: 369,870

[22] Filed: Jun. 22, 1989

[51] Int. Cl.[5] ..... B28B 11/00

[52] U.S. Cl. ..... 425/456; 248/205.5; 248/362; 294/64.1; 366/108

[58] Field of Search ..... 248/680, 467, 205.5, 248/205.6, 205.7, 205.8, 205.9, 206.1, 206.2, 206.3, 206.4, 309.3, 684, 362, 363; 269/21; 366/108; 294/64.1; 264/69, 71; 425/432, 456

[56] References Cited

U.S. PATENT DOCUMENTS

| | | | |
|---|---|---|---|
| 762,499 | 6/1904 | Sprague | 294/64.1 |
| 799,922 | 9/1905 | Moxham | 269/21 |
| 2,783,018 | 2/1957 | Lytle | 294/64.1 |
| 2,853,333 | 9/1958 | Littell | 294/64.1 |
| 3,152,828 | 10/1964 | Lytle | 294/64.1 |
| 3,853,345 | 12/1974 | Miller | 294/64.1 |
| 3,910,620 | 10/1975 | Sperry | 248/362 |
| 4,579,697 | 4/1986 | Takano . | |
| 4,580,456 | 4/1986 | Takano . | |

FOREIGN PATENT DOCUMENTS

| | | | |
|---|---|---|---|
| 3724659 | 2/1989 | Fed. Rep. of Germany | 294/64.1 |
| 2262751 | 9/1975 | France | 248/205.9 |
| 640952 | 1/1979 | U.S.S.R. | 294/64.1 |

*Primary Examiner*—David M. Purol
*Assistant Examiner*—Robert A. Olson
*Attorney, Agent, or Firm*—Ladas & Parry

[57] ABSTRACT

An improved vibrator for architectural or civil engineering use is disclosed. The vibrator includes a vibrating means which is either a conventional reciprocating or rotating vibrator, and a suction means which is integrally formed with the vibrating means and has at least one suction member to be attached to the forming molds. The suction means of the improved vibrator enables an air tight connection between the vibrator and the forming molds. The suction means is substantially in the shape of a disc with an air passage formed therein to be operated via an air pump to produce a low pressure area in the disc body. The suction member comprises at least one flexible gasket at the periphery of the disc body which is attached to the forming mold to form an ideal attachment.

3 Claims, 3 Drawing Sheets

VIBRATOR WITH SUCTION APPARATUS

BACKGROUND OF THE INVENTION

The present invention relates to an improved vibrator with suction apparatus, and more particularly to a vibrator used in architecture or civil engineering use.

In the ordinary process for architecture or civil engineering, especially those concerned with the construction of a building, vibrators are attached onto a concrete mold to drive out any possible air bubbles remaining within the freshly poured concrete. This vibration process is one of the standard processes for achieving construction of good quality. The greater the amount of vibration applied on the freshly poured concrete, the stronger the construction and the finer the outer surface thereof will be when said concrete dries.

The difficulties encountered in the use of a conventional vibrator are the time and labor-consumption required for installation, the need for the use of many sets of vibrators to manipulate the poured concrete confined in a single set of molds, and the inconvenience in detaching the vibrator from the mold, etc. In addition, it is unavoidably necessary to equip a seat member on the mold so that the vibrator may be installed thereon to avoid possible damage to the mold itself. This is true when using a steel mold for constructing a building.

Automatic rotation vibrators, abbreviated as ARV's, were developed several years ago and protected by U.S. Pat. Nos. 4,579,697 and 4,580,456. The front schematic diagram of an automatic rotation vibrator is shown in FIG. 1, and a perspective view of the same when attached on the ribs of a mold is shown in FIG. 2. The vibrator 10 includes a vibrating apparatus 11 and a positioning apparatus 12 which further consists of a fixed jaw 121 and a moving jaw 122 for clamping onto the ribs 13 of the mold in a manner as shown in FIGS. 1 and 2. Although the vibrator 10 is advantageous in its attachment to the mold because said vibrator uses the positioning apparatus 12 to clamp onto the ribs 13 of the mold, the attachment of said vibrator 10 is impossible if there are no reinforcing ribs on the forming molds.

SUMMARY OF THE INVENTION

It is therefore the principle object of the present invention to provide an improved vibrator which is particularly suitable for use in architectural or civil engineering constructions and overcomes the disadvantages of the conventional vibrators.

The most important advantages of the improved vibrator of the present invention are ease of installation onto the forming mold of the concrete and convenience of portability to enable the same to be easily transported from place to place. Therefore, only one set of the vibrators of this invention will be sufficient to treat a forming mold with relatively large surface area.

An object, as well as an important feature, of the vibrator of the present invention is to provide a suction apparatus on the improved vibrator to enable the easy attachment of the same onto a forming mold.

Accordingly, the improved vibrator of this invention comprises a vibrating means and a suction means integrally formed with said vibrating means, which is substantially in the shape of a disc with a flexible peripheral lip portion and a low pressure chamber portion for resulting in air tight attachment onto the forming mold.

BRIEF DESCRIPTION OF THE DRAWINGS

These and other advantages, objects and features of the improved vibrator of the invention will become apparent from the following detailed description of the preferred embodiments with reference to the accompanying drawings.

DETAILED DESCRIPTION OF THE PREFERRED EMBODIMENTS

Figure 1:
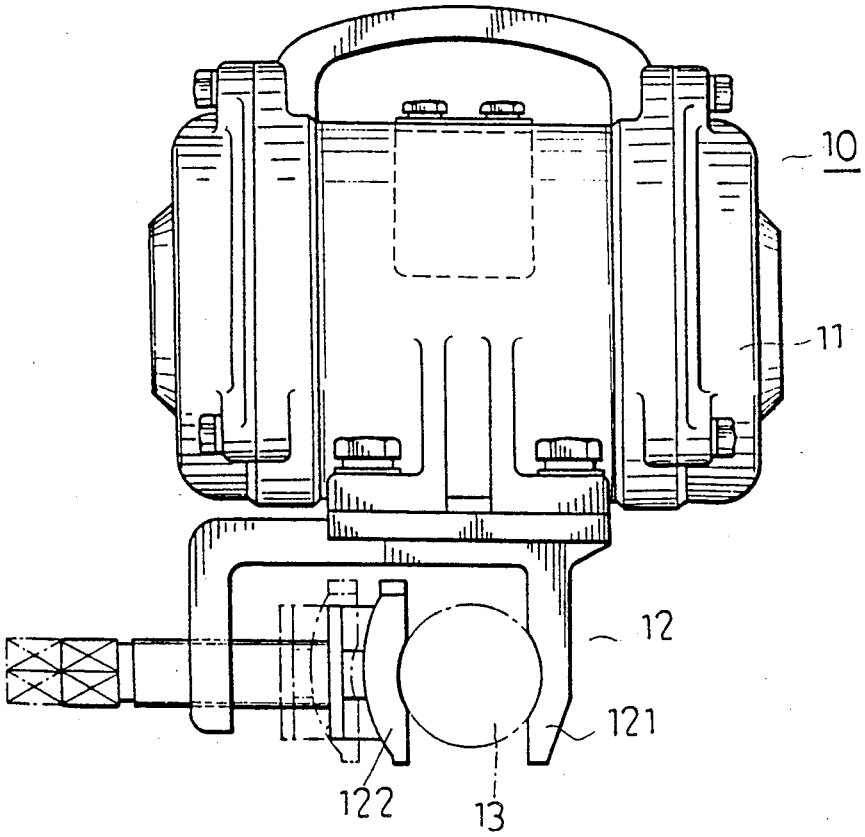
FIG. 1 is a schematic front view of the conventional auromatic rotation vibrator.
Figure 2:
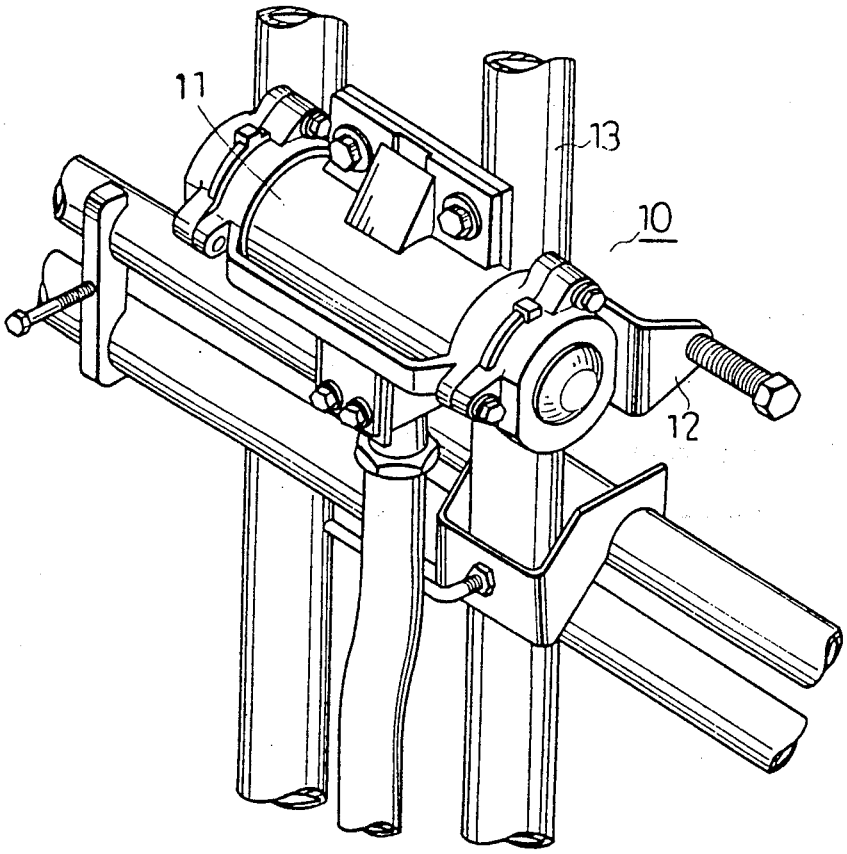
FIG. 2 is a perspective view showing a conventional automatic rotation vibrator installed onto the ribs of a forming mold.
Figure 3:
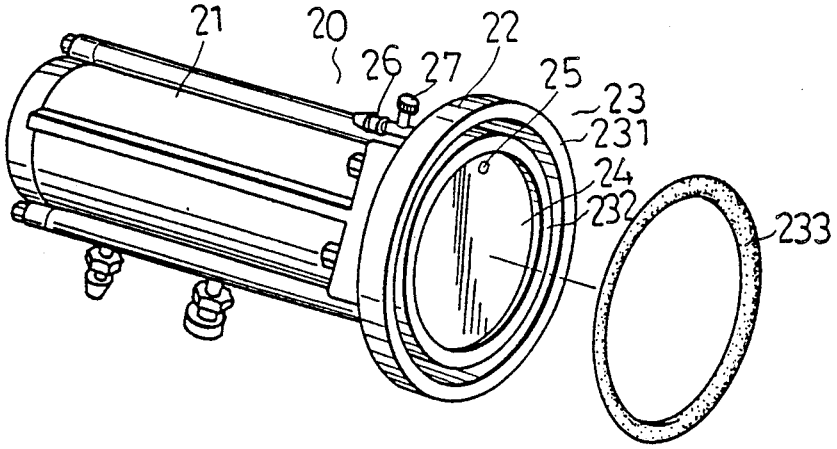
FIG. 3 is an exploded perspective of a first embodiment of the improved vibrator of the invention.

Referring to FIG. 3, which shows a perspective view of an improved vibrator of this invention, the vibrator 20 comprises a vibrating means 21, which can be a conventional reciprocal or rotational vibrating mechanism, and a suction means 22 integrally formed with the vibrating means 21. Since the vibrating means 21 has a conventional structure and merely performs a vibration function, it will not be detailed for the purpose of simplicity. Those who are skilled in the art of such vibrating mechanisms, will be able to duplicate such a vibrating means 21.

The suction means 22 substantially comprises a body 24 in the shape of a disc having a lip portion 23 at the periphery thereof. The lip portion 23 includes two concentric annular flanges 231, 232 with a flexible gasket 233 clamped therebetween. The gasket 233 will deform a little bit while being connected with the surface of the forming mold so as to form an air tight attachment thereto. An air passage 25 is formed on the disc body 24 in communication with an adaptor 26 which is formed on the back side of the disc body 24. A control switch 27 is provided at the vicinity of the adaptor 26.

In operation, the vibrator 20 is positioned on an area on the outer surface of a forming mold where vibration is to be applied. An air pump is then operated with the pipe thereof connected to the adaptor 26 of the vibrator 20. The interior of the disc body 24 will become a low pressure area due to the action of the air pump. The suction means 21, with the gasket 233 thereof in contact with the forming mold, tightly attaches to the mold by means of suction. In order to prevent any possible movement of the vibrator 20 on the forming mold, the air pump remains operating during the vibration process. Of course, if there is perfect surface-to-surface contact between the gasket 233 and the forming mold, one can turn off the control switch 27 after the air tight attachment is achieved.

After the vibration process is completed, the vibrator 20 of this invention can be very easily removed from the forming mold by stopping the operation of the air pump or turning on the control switch 27. The vibrator 20 may then be transported to another location on the forming mold to continue the vibration process.

Figure 4:
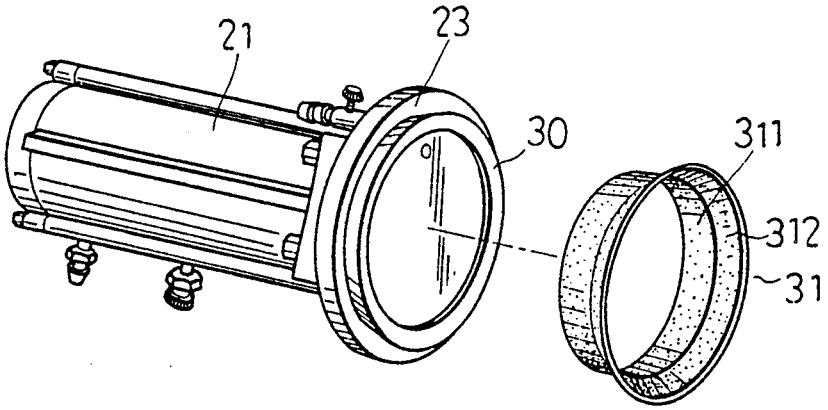
FIG. 4 is an exploded perspective view of a second embodiment of the improved vibrator of the invention.

FIG. 4 shows another embodiment of the improved vibrator of this invention. In this embodiment, the vibrator has a structure which is substantially the same as that of the vibrator shown in FIG. 3, in terms of the vibrating means 21 and the suction means 22 thereof. However, there is only one peripheral annular flange 30 at the lip portion 23 of the suction means. The flexible gasket 31 comprises a base 311 with a horn-like rim portion 312 extending therefrom for achieving an ideal air tight contact with the forming mold. The operation of this embodiment of the vibrator is exactly the same as that of the vibrator shown in FIG. 3.

Although this invention has been described by way of preferred embodiments, modifications and changes are still possible for those skilled in the art without departing from the spirit of the invention.

What is claimed is:

1. A vibrator for packing freshly poured concrete confined in a forming mold comprising:

a vibrator body; and a suction disc means serving to connect said vibrator body to the forming mold, said suction disc means having a rigid disc which has one end secured to said vibrator body and another end with an annular flange defining a vacuum chamber, and a flexible and resilient gasket to provide a gas-tight seal between the forming mold and said rigid disc, said gasket having a cylindrical portion disposed in a tight fit around said annular flange and having a horn-like annular flared portion extending from and inclining away from said cylindrical portion, said annular flared portion flexing from said cylindrical portion to an extent sufficient to place said annular flange of said rigid disc in contact with the forming mold when a vacuum is created in said vacuum chamber.

2. The vibrator as claimed in claim 1, wherein defined in said suction disc means is an air passage which communicates with said vacuum chamber and a point external to said vibrator, and wherein said vibrator further comprises an adapter formed on a surface of said vibrator and connected to said suction disc means, said adaptor being in alignment with said air passage.

3. A vibrator as claimed in claim 2, wherein said suction disc means further comprises a control switch provided in the vicinity of said adaptor for starting and stopping an air pumping operation of said suction means which creates a vacuum in said vacuum chamber.

* * * * *